US006947688B2

(12) United States Patent
Inoue et al.

(10) Patent No.: US 6,947,688 B2
(45) Date of Patent: Sep. 20, 2005

(54) IMAGE-FORMING APPARATUS INCLUDING FIRST AND SECOND CHARGING MEMBERS WITH A TARGET POTENTIAL CHARGING FEATURE

(75) Inventors: Ryo Inoue, Ibaraki (JP); Mitsuhiro Ota, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/610,586

(22) Filed: Jul. 2, 2003

(65) Prior Publication Data

US 2004/0005171 A1 Jan. 8, 2004

(30) Foreign Application Priority Data

Jul. 4, 2002 (JP) ..... 2002-195665

(51) Int. Cl.[7] ..... G03G 15/02
(52) U.S. Cl. ..... 399/174; 399/50
(58) Field of Search ..... 399/174, 50

(56) References Cited

U.S. PATENT DOCUMENTS 5,805,960 A 9/1998 Suzuki et al. ..... 399/149
5,809,379 A 9/1998 Yano et al. ..... 399/159
5,895,146 A 4/1999 Waki et al. ..... 399/170
2002/0076239 A1 6/2002 Inoue ..... 399/167

FOREIGN PATENT DOCUMENTS

JP 6-3921 1/1994
JP 8-44153 2/1996
JP 09244355 A * 9/1997 ..... G03G/15/02

* cited by examiner

*Primary Examiner*—Quana Grainger
(74) *Attorney, Agent, or Firm*—Fitzpatrick, Cella, Harper & Scinto

(57) ABSTRACT

According to the present invention, in an image-forming apparatus having at least two chargers for charging a rotating image carrier, in accordance with change in bias applied to a second charger disposed on the downstream side in a rotational direction of the image carrier, the bias applied to a first charger disposed on the upstream side is changed. Thereby, the electric power required for the charging is reduced.

4 Claims, 3 Drawing Sheets

IMAGE-FORMING APPARATUS INCLUDING FIRST AND SECOND CHARGING MEMBERS WITH A TARGET POTENTIAL CHARGING FEATURE

BACKGROUND OF THE INVENTION

1. Field of the Invention

The present invention relates to an image-forming apparatus such as a copying machine having a plurality of charging means for an image carrier and controlling means for controlling the charging means.

2. Description of the Related Art

In a conventional image-forming apparatus such as a copying machine, a rotary photosensitive drum 1 as an image carrier is uniformly charged by one charging member 2 so that an electrostatic latent image is formed thereon by exposing means such as semiconductor laser 7 in accordance with image information. A metallic circular cylinder with an external surface having a photosensitive layer is used as the photosensitive drum 1. Then, the latent image is developed by developing means 3 so as to form a toner image on the photosensitive drum 1. The toner image formed on the photosensitive drum 1 is transferred on a recording sheet by a transferring member 4 and fixed thereon by fusing means 6 so as to have a permanent image. After the transferring of the toner image, the photosensitive drum 1 is finally cleaned by cleaning means 5.

If the surface velocity of the photosensitive drum 1 is increased for improving a printing speed, the surface potential of the photosensitive drum 1 cannot have a desired value with one time charging, so that several times of charging are required to form the latent image, delaying the printing speed.

Then, Japanese Patent Laid-Open No. 8-44153 discloses an image-forming apparatus having a plurality of chargers so as to reduce the charging time.

However, in the above-mentioned image-forming apparatus having a plurality of the chargers, even when the photosensitive drum 1 is charged at the same potential, there is a disadvantage that the power consumption is increased in accordance with the combination of voltages applied to each charger.

SUMMARY OF THE INVENTION

It is an object of the present invention to provide an image-forming apparatus having a plurality of chargers for charging an image carrier and being capable of reducing the power consumption required for charging the image carrier by optimizing the voltage applied to each charger.

Further objects, features and advantages of the present invention will become apparent from the following description of the preferred embodiments with reference to the attached drawings.

DESCRIPTION OF THE PREFERRED EMBODIMENTS

Figure 1:
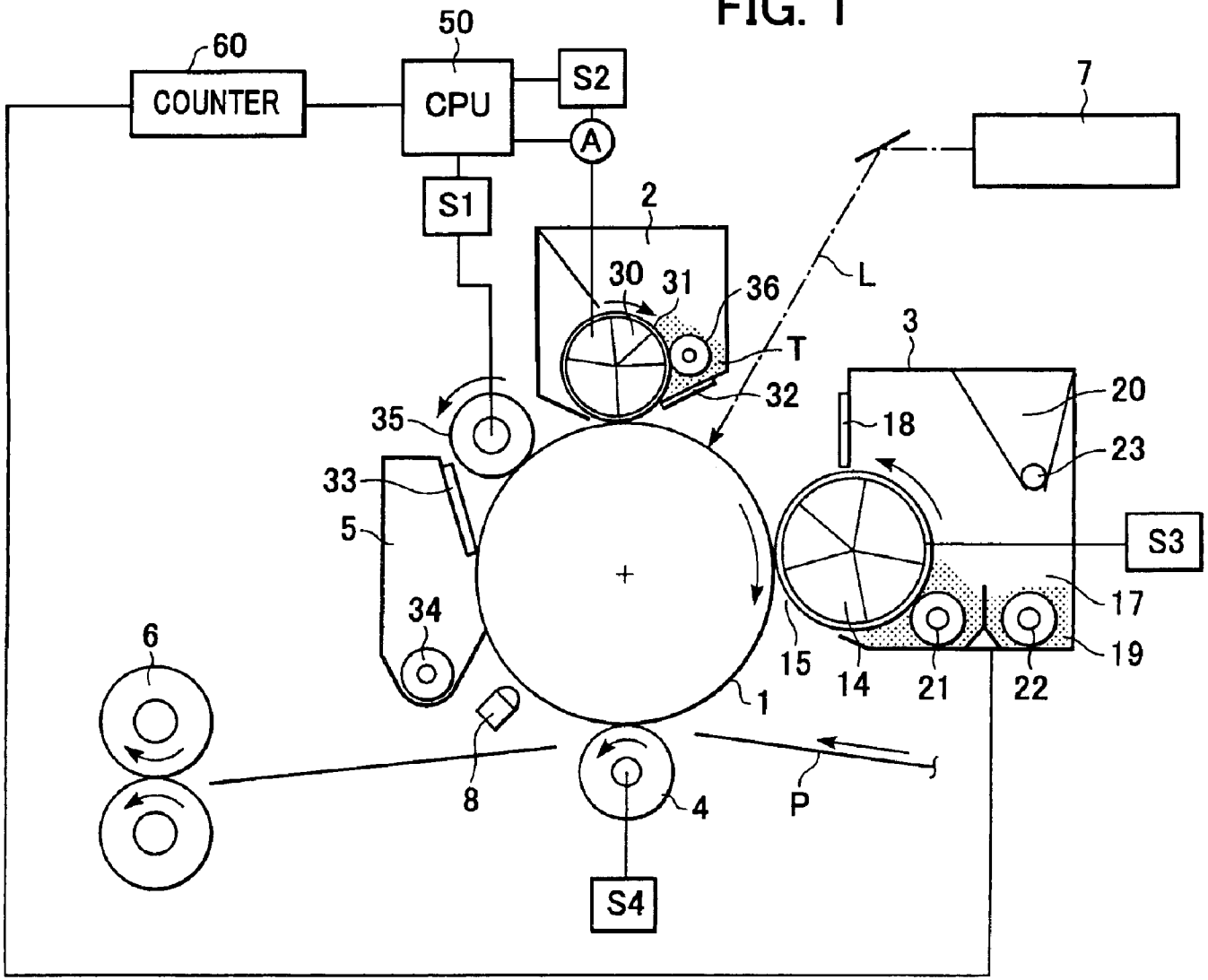
FIG. 1 is a drawing of an essential part of an image-forming apparatus according to an embodiment of the present invention.

FIG. 1 shows an embodiment according to the present invention. The embodiment will be described below with reference to the drawings. As an image carrier, the photosensitive drum 1 is a rotary drum-type electrophotographic receptor and is rotated in an arrow direction. The photosensitive drum 1 according to the embodiment is a conductive member such as aluminum having a layer made of a-Si (amorphous silicon) formed thereon. The peripheral surface of the rotating photosensitive drum 1 is charged at a desired potential by a first charger 35 and a second charger 2.

According to the present invention, the electric power required for charging the image carrier is reduced by controlling bias applied to the two above-mentioned chargers.

According to the embodiment, the second charger 2 is provided with a rotatable sleeve 31 with a diameter of 16 mmϕ and having a magnet roller 30 fixed inside the sleeve 31. The sleeve 31 is arranged at a distance of 500 $\mu$m from the photosensitive drum 1 so that conductive magnetic particles magnetically restrained to the magnet roller 30 are brought into contact with the photosensitive drum 1. To the sleeve 31, bias is applied from a power supply S2 so that a current flows therethrough via the conductive magnetic particles, and the photosensitive drum 1 is charged. The current flowing through the second charger 2 is measured with an ammeter A. The output of the power supply S2 is controlled by controlling means 50 for controlling the output of the power supply S2 with a method, which will be described later. According to the embodiment, the bias overlapped with a DC voltage of −550 v is applied to an alternating electric field with a voltage between peaks of 500 v and a frequency of 1 kHz, for example.

In the second charger 2, the conductive magnetic particles magnetically restrained to the magnet roller 30 are brought into contact with the photosensitive drum 1 after the layer thickness of the particles is restricted with a blade 32. The sleeve 31 is driven in an arrow direction by driving means (not shown), so that the sleeve 31 rotates at a peripheral velocity of 150 mm/s.

In view of the contact frequency between the photosensitive drum 1 and the conductive magnetic particles, and of preventing the problem that the conductive magnetic particles fly against the magnetic restriction, it is preferable that the peripheral velocity of the sleeve 31 be from 50 to 250 mm/s.

In the vicinity of the nearest-neighbor between the photosensitive drum 1 and the sleeve 31, the magnetic flux density due to the magnet on the sleeve 31 is $950\times10^{-4}$ T (tesla).

On the upstream side of the blade 32 in the rotating direction of the sleeve 31, a pool T of the conductive magnetic particles is provided, and a screw 36 mixes the magnetic particles in the pool T in the bus-line direction of the sleeve 31. The screw 36 has elliptical blades alternately attached thereto so that the magnetic particles in the pool T can be uniformly mixed.

The following magnetic particles may be preferably used:

1) Molded particles made by kneading a resin and magnetic powder such as magnetite, or these particles having conductive carbon mixed thereto for the resistance adjustment.
2) Sintered magnetite, ferrite, or these materials reduced or oxidized for the resistance adjustment.
3) The above magnetic particles coated with a resistance-adjusted coating material such as a phenol resin having dispersed carbon particles, or plated with a metal such as Ni, for adjusting the resistance at an appropriate value.

In view of the charging capability of the second charger 2 and of preventing the electric discharge due to micro-defects of a layer of a-Si formed on the surface of the photosensitive drum 1, the resistance of these conductive magnetic particles may preferably be from 1×E4($10^4$) to 1×E7($10^7$) Ω.

As for the magnetic characteristics of the magnetic particles, the higher the magnetic restriction force is, the better is for preventing the magnetic particles from adhering to the photosensitive drum, so that it is preferable that a saturated magnetization be 50 ($A \cdot m^2/kg$) or more.

In the magnetic particles used in practice according to the embodiment, the average volumetric particle diameter is 30 μm; the apparent density is 2.0 $g/cm^3$; the resistance is 1×E6 Ω; and the saturated magnetization is 58 ($A \cdot m^2/kg$).

The particle diameter of the magnetic particles affects on the charging capability and the charging uniformity. That is, the excessive large particle diameter reduces the contact frequency with the photosensitive drum 1, resulting in the charging nonuniformity. If the particle diameter is small, although the charging capability and uniformity are improved, the magnetic force applied to one particle is reduced, so that the adhesion to the photosensitive drum 1 is liable to occur. Therefore, the magnetic particles with a particle diameter from 5 to 100 μm may be preferably used.

The total weight of the magnetic particles is 200 g and a total of the magnetic particles is gently agitated by the agitating effect due to the screw 36 and the repelling pole of the magnet roller 30.

Also, the second charger 2 charges the photosensitive drum 1 by a so-called infusion charging system disclosed in Japanese Patent Laid-Open No. 6-3921, which is the charging by directly applying an electric charge to a member to be charged from a charging member contacting the member to be charged. According to this system, since the discharge phenomenon is not utilized, the surface of the photosensitive drum 1 is charged at substantially the same potential as the bias DC voltage applied to the charging member. Therefore, in comparison with the charging using the discharge phenomenon, it is sufficient to apply lower voltage to the charging member, enabling the ozone-less charging by small electric power to be achieved.

The first charger 35 is arranged on the upstream side of the second charger 2 in the rotational direction of the photosensitive drum 1, and is contacting with the photosensitive drum 1. The first (sub-) charger 35 is a stainless steel core-bar with a diameter of 6 mmϕ and having an elastic layer formed on the external periphery thereof with a thickness of 3 mm and made of EPDM (ethylene-propylene-diene-monomer) having carbon black dispersed thereon; and a film layer formed by a dipping method as a resistance control layer. This is heated and dried for a period of 30 min at a temperature of 150° C. so as to have a roller with a diameter of 12 mmϕ and having the elastic layer and the resistance control layer.

To the first charger 35, a bias is applied by a power supply S1. The output of the power supply S1 is controlled by the controlling means 50 for controlling the output of the power supply S1 with a method, which will be described later. According to the embodiment, a voltage of −700 V is applied, for example. The first charger 35 charges the photosensitive drum 1 by a corona discharge phenomenon produced in a small gap between the first charger 35 and the photosensitive drum 1 in the vicinity of the contacting portion between the first charger 35 and the photosensitive drum 1.

As the first charger, the infusion charging system charger may also be used in the same way as in the second charger 2.

Then, the photosensitive drum 1 is exposed by image exposing means for emitting light based on an image signal. The potential of the exposed portion is changed so that an electrostatic latent image is formed on the surface of the photosensitive drum 1.

Next, the electrostatic latent image is developed by the developing means 3 so as to form a toner image.

The developing means 3 has a rotating sleeve 15 having a magnet roll 14 fixed inside the sleeve 15, so that the sleeve 15 is coated with developer 19 in a developer container 17 like a thin layer by a blade 18 so as to transfer the developer 19 to the vicinity of the photosensitive drum 1. At this time, the sleeve 15 is driven by a motor (not shown) so as to rotate at a surface velocity of 300 mm/s in the arrow direction. As the developer 19, a so-called two-component developer, which is a mixture of toner and a magnetic carrier, is used. This is a mixture of negative charging toner with a diameter of about 8 μm and a positive charging magnetic carrier with a diameter of about 50 μm at a toner percent by weight (toner weight/carrier weight) of 5%. The toner percentage is detected by an optical concentration sensor (not shown) so that toner in a toner hopper 20 is replenished by a supply roller 23. The developer within a container is uniformly agitated by agitating members 21 and 22. To the sleeve 15, a developing bias, in which a DC voltage of −500 v is superimposed on an alternate voltage with a voltage between peaks of 2 Kv and a frequency of 2 KHz, is applied from the power supply S2. The developer transferred on the sleeve 15 like a thin layer is transferred to the photosensitive drum 1 by an electric field, in which a DC electric field is superimposed on an alternating electric field.

Furthermore, the toner image on the photosensitive drum 1 is transferred on a transfer material P by transferring means 4. As the transferring means 4, a member of a core bar having an elastic layer formed on the external periphery of the core bar is used so as to form a transfer nip by urging the transferring means 4 in contact with the photosensitive drum 1 through a predetermined urging force.

The transferring means 4 rotates in a direction forward to the rotational direction of the photosensitive drum 1 at substantially the same peripheral velocity as that of the photosensitive drum 1. Also, to the core bar of the transferring means 4, a predetermined bias with the reverse polarity (plus according to the embodiment) to the toner charging polarity is applied at predetermined control timing from a power supply S4.

From a sheet-supply mechanism (not shown), the transfer material P is supplied as a toner acceptor (recording medium) to the transfer nip at a predetermined control timing so as to be pinched and transferred through the transfer nip. During the transferring through the nip of the transfer material P, to the core bar of the transferring means 4, a predetermined bias with the reverse polarity (plus according to the embodiment) to the toner charging polarity is applied from the power supply S4, so that the toner images on the surface of the photosensitive drum 1 are electrostatically transferred to the surface of the transfer material P.

The transfer material P exiting from the transfer nip is separated from the photosensitive drum 1 and conveyed to the fusing means 6 so that the unfixed toner images are thermally fixed on the surface of the transfer material P as permanent fixed images and discharged as an image-formed material (print or copy).

After the transferring the toner images, the photosensitive drum 1 is irradiated (totally exposed) and statically eliminated by eliminating means 8 for eliminating the image history. According to the embodiment, as the eliminating means 8, an LED emitting light with a center wavelength of 660 nm and an amount of light of 8 ls (lumen second) is used.

The photosensitive drum 1 after the static elimination is cleaned by a cleaner 5 arranged in the next to the eliminating means 8 so that residual toner and dust remaining on the surface of the photosensitive drum 1 after the separation of the transfer material are eliminated. The cleaner 5 comprises a cleaning blade 33 made of silicon denatured polyurethane rubber and bonded on a support plate. The toner scraped down from the photosensitive drum 1 by the cleaning blade 33 is conveyed to a spent toner container (not shown) by a screw 34 for recovery.

The photosensitive drum 1 cleaned by the cleaner 5 is charged again with the first and second chargers 35 and 2 so as to form images.

Also, the operation of the image-forming apparatus is controlled by the controlling means 50, which further controls voltages applied to the first and second chargers 35 and 2.

A method for controlling voltages applied to the first and second chargers 35 and 2 will be described below.

According to the embodiment, currents flowing through the first and second chargers 35 and 2 are directly proportional to voltages applied to these chargers, respectively.

Therefore, the electrical power required for the charging is proportional to the sum of absolute current values flowing through the two chargers.

According to the embodiment, the surface potential of the photosensitive drum 1 after the charging by the second charger 2 is adjusted in accordance with the number of printings since the toner replenishment to the toner hopper 20 in order to prevent the fogging halation of a non-image range.

A counter 60 counts the number of printings since the toner replenishment to the toner hopper 20, and the controlling means 50 adjusts the voltage of the DC component of the voltage applied to the second charger 2 based on the counted result. The DC potential of the voltage applied to the second charger 2 adjusted in accordance with the number of printings is referred to below as a target potential.

The toner replenishment is performed every toner consumption equivalent to 15,000 A-4 size sheets with a printing rate of 4%. The DC component of the voltage applied to the second charger 2, i.e., the target potential, is −450 v from the first to the 5,000th of the number of printings; −550 v from the 5,000th to the 10,000th; and is −650 v from the 10,000th to 15,000th. The bias applied to the developing means 3 is also changed according to the target potential.

Tables 1, 2, and 3 show currents flowing through the first charger 35 and the second charger 2 and the uniformities of the printed image density when DC components of the voltages of −450 v, −550 v, and −650 v are applied to the second charger 2 and the voltage applied to the first charger 35 is changed in 100 v steps, respectively. The uniformity evaluation A is selected in consideration of the uniformity of the printed image density.

When the first charger employs the infusion charging system, if the DC voltage applied to the first charger is 80% or more of that applied to the second charger 2, the uniformity evaluation A is obtained.

TABLE 1

Vm = −450 v

| First charger voltage [V] | | First charger | Second charger | Total current ab- | Density non- |
|---|---|---|---|---|---|
| Corona discharge | Infusion charging | current I1 [μA] | current I2 [μA] | solute value [μA] | uniformity level |
| non | — | — | 183.3 | | C |
| −400 | −200 | 95.8 | 50.5 | 146.3 | B |
| −500 | −300 | 122.9 | 28.8 | 151.7 | A |
| −600 | −400 | 147.9 | 3.5 | 151.4 | A |
| −700 | −500 | 172.9 | −20.8 | 193.7 | A |
| −800 | −600 | 197.9 | −44 | 241.9 | A |
| −900 | −700 | 225 | −68.2 | 293.2 | B |
| −1000 | −800 | 250 | −90.5 | 340.5 | B |
| −1100 | −900 | 275 | −114.5 | 389.5 | C |
| −1200 | −1000 | 302.1 | −138 | 440.1 | C |

TABLE 2

Vm = −550 v

| First charger voltage [V] | | First charger | Second charger | Total current ab- | Density non- |
|---|---|---|---|---|---|
| Corona discharge | Infusion charging | current I1 [μA] | current I2 [μA] | solute value [μA] | uniformity level |
| non | — | — | 183.3 | | C |
| −400 | −200 | 95.8 | 75 | 170.8 | B |
| −500 | −300 | 122.9 | 50 | 172.9 | B |
| −600 | −400 | 147.9 | 27.1 | 175 | A |
| −700 | −500 | 172.9 | 4.2 | 177.1 | A |
| −800 | −600 | 197.9 | −20.8 | 218.7 | A |
| −900 | −700 | 225 | −45.8 | 270.8 | A |
| −1000 | −800 | 250 | −66.7 | 316.7 | B |
| −1100 | −900 | 275 | −87.5 | 362.5 | B |
| −1200 | −1000 | 302.1 | −110.4 | 412.5 | C |

TABLE 3

Vm = −650 v

| First charger voltage [V] | | First charger | Second charger | Total current ab- | Density non- |
|---|---|---|---|---|---|
| Corona discharge | Infusion charging | current I1 [μA] | current I2 [μA] | solute value [μA] | uniformity level |
| non | — | — | 183.3 | | C |
| −400 | −200 | 95.8 | 69.4 | 165.2 | B |
| −500 | −300 | 122.9 | 73.3 | 196.2 | B |
| −600 | −400 | 147.9 | 50.6 | 198.5 | B |
| −700 | −500 | 172.9 | 28 | 200.9 | A |
| −800 | −600 | 197.9 | 3.5 | 201.4 | A |
| −900 | −700 | 225 | −20.1 | 245.1 | A |
| −1000 | −800 | 250 | −42.5 | 292.5 | B |
| −1100 | −900 | 275 | −68 | 343 | B |
| −1200 | −1000 | 302.1 | −90.6 | 392.7 | B |

According to the results shown in TABLES 1, 2, and 3, when DC components of the biases of −450 v, −550 v, and −650 v are applied to the second charger 2, if voltages of −600 v, −600 v, and −700 v are applied to the first charger 35, the electric power required for the charging is minimized.

Then, the inventor has found that substantially the same advantages can be obtained by selecting the bias applied to the first charger 35 so that the absolute current value flowing through the second charger 2 is minimized. That is, when DC components of the bias of −450 v, −550 v, and −650 v are applied to the second charger 2, the voltages applied to the first charger 35 are selected to be −600 v, −700 v, and −800 v. When employing the method that the bias applied to the first charger 35 is selected so that the current flowing through the second charger 2 is minimized, measuring means for measuring the current flowing through the first charger 35 is not necessary, enabling the apparatus cost to be reduced.

Figure 2:
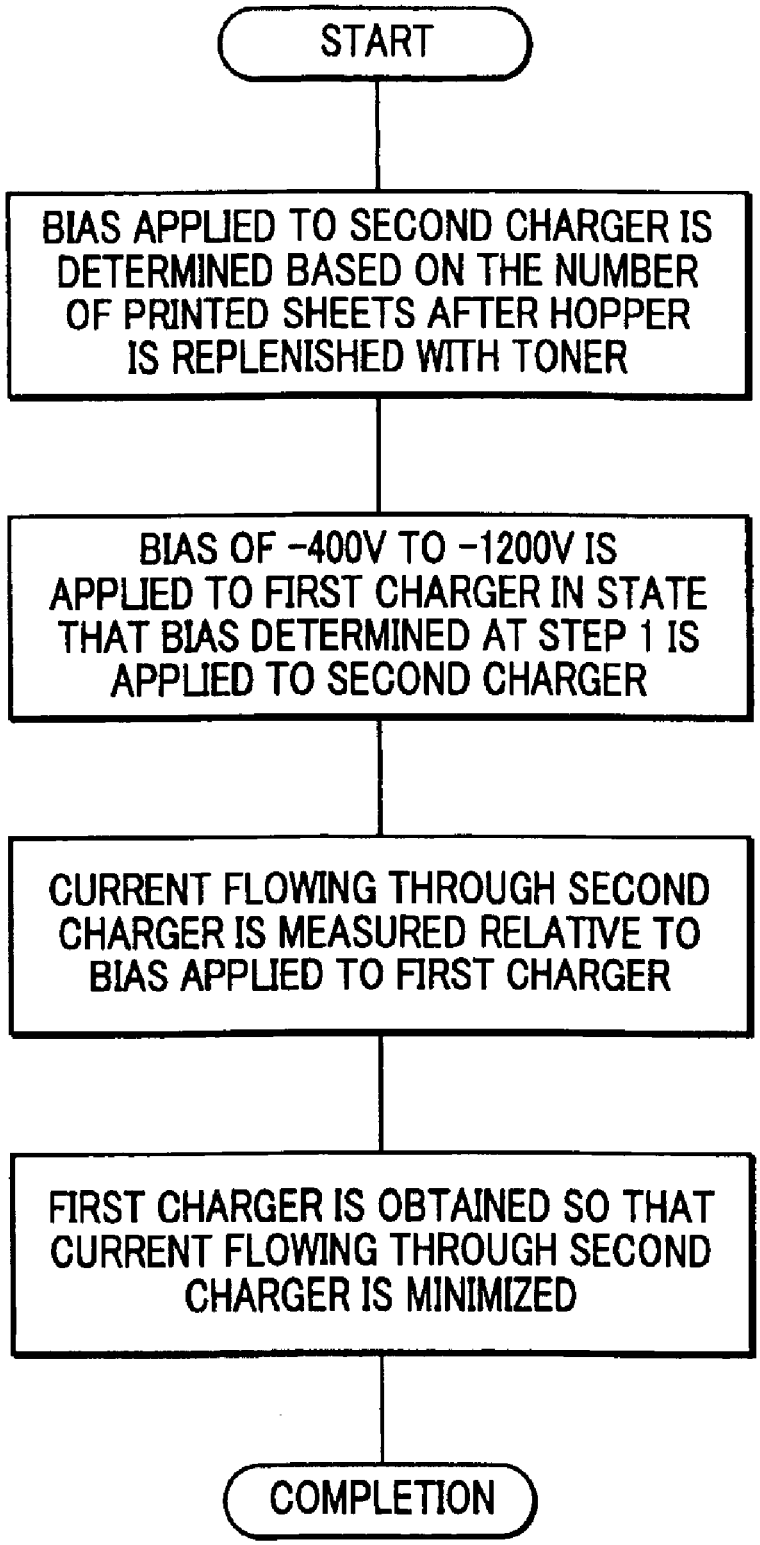
FIG. 2 is a flow chart of a procedure for determining voltages applied to a first charger 35 and a second charger 2.
Figure 3:
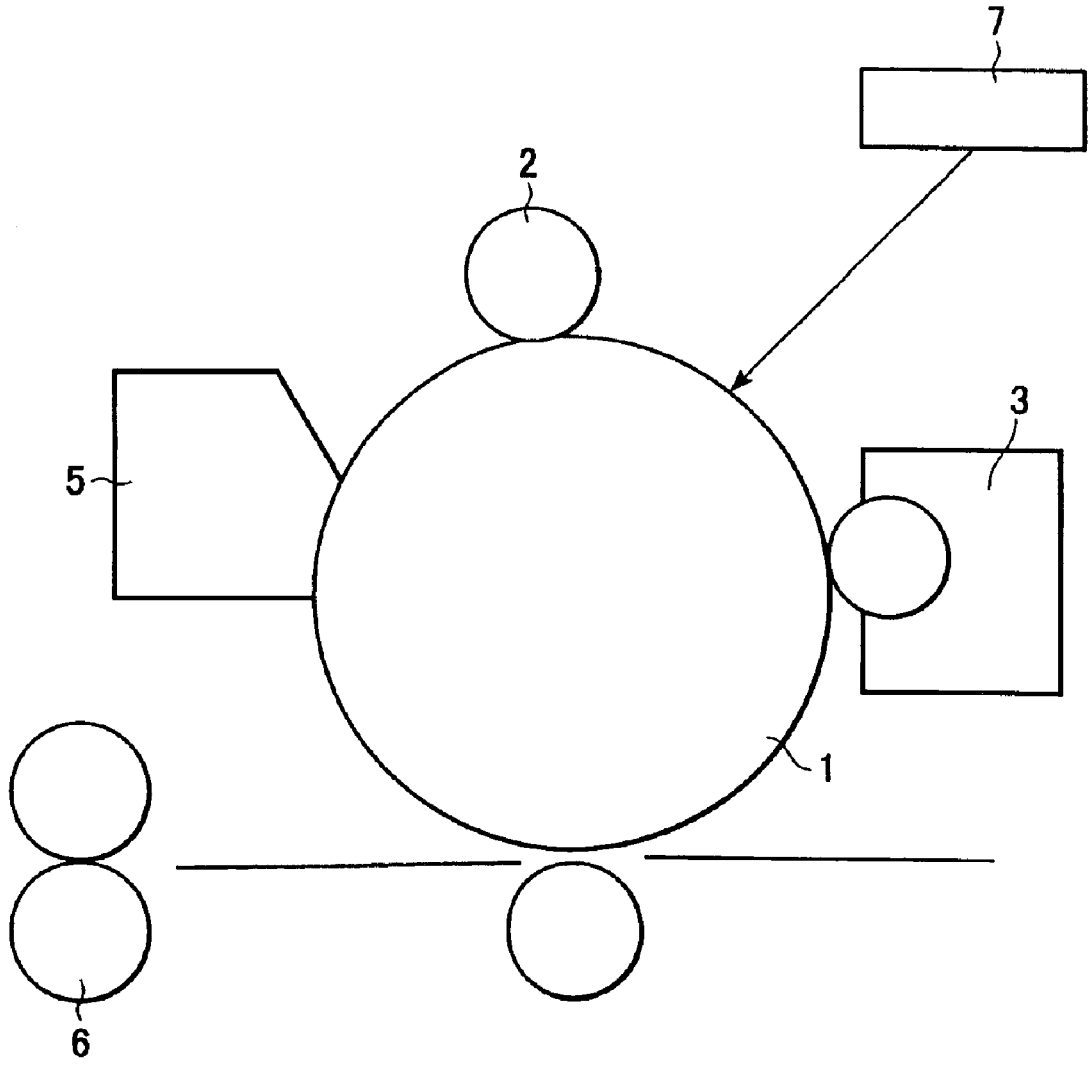
FIG. 3 is an explanatory drawing of a conventional example.

Then, according to the embodiment, voltages applied to the first charger 35 and the second charger 2 are determined according to the procedure shown in FIG. 2.

First, the DC component of the bias voltage applied to the second charger 2 is determined based on the number of printed sheets counted by the counter 60 since the toner hopper 20 is replenished with toner (Step 1). Continuously, in the state that the bias determined at Step 1 is applied to the second charger 2, biases of from −400 v to −1,200 v are applied to the first charger 35 in 100 v steps (Step 2). For each bias applied to the first charger 35, the current flowing through the second charger 2 is measured (Step 3). The bias minimizing the current flowing through the second charger 2 is determined to be the bias applied to the first charger 35 (Step 4).

Symbols A, B, C, D, and E used for the image quality evaluation in TABLES 1, 2, and 3 denote as follows:

A: Very excellent images entirely without nonuniformity in density.

B: Excellent images substantially without nonuniformity in density.

C: No-problem level images with some nonuniformity in density.

D: Not excellent images with plenty of nonuniformity in density.

E: Inferior images with very plenty of non-uniformity in density.

Wherein the evaluations C or higher (A to C) are levels used without problems. In the sign of the current, the plus sign means that the current flows in the forward direction relative to the applied DC voltage and the minus sign means the reverse direction. That is, the plus sign means the charging and the minus sign means discharging.

According to the embodiment, two chargers are used for charging the photosensitive drum 1; alternatively, three or more chargers may be provided so that the current flowing through the charger of the three chargers disposed in the nearest to the developing means 3 and on the upstream side in the rotational direction of the photosensitive drum 1 is minimized by controlling voltages applied to the other chargers so as to have the same advantages.

As described above, according to the present invention, in the image-forming apparatus having a plurality of charging means for charging the photosensitive body and for controlling the bias applied to the charging means by controlling means, the electric power required for the charging has been reduced by changing the voltage applied to the first charger in accordance with the change of the target potential made by the second charger. Furthermore, when the infusion charging system charger is used as the first charger, if the voltage applied to the first charger is 80% or more of the target potential, uniform images have been obtained.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image-forming apparatus comprising:

a movable image bearing member;

a first charging member for charging said image bearing member;

a second charging member disposed on the downstream side of said first charging member with respect to a direction of movement of said image bearing member for charging said image bearing member, which is charged by said first charging member at a target potential; and voltage-setting means for setting a voltage applied to said first charging member, wherein said voltage-setting means sets a voltage applied to said first charging member based on an absolute value of a current flow from said second charging member to said image bearing member after a voltage applied to said second charging member is set based on the target potential.

2. An image-forming apparatus according to claim 1, said voltage-setting means sets the voltage applied to said first charging member for lessening the absolute value of the current.

3. An image-forming apparatus according to claim 1, wherein the absolute value of the current is lessened, a value of the voltage applied to said first charging member is increased.

4. An image-forming apparatus according to claim 1, the voltage applied to said first charging member and voltage applied to said second charging member have the same polarity.

* * * * *

UNITED STATES PATENT AND TRADEMARK OFFICE

CERTIFICATE OF CORRECTION

PATENT NO. : 6,947,688 B2
DATED : September 20, 2005
INVENTOR(S) : Ryo Inoue et al.

It is certified that error appears in the above-identified patent and that said Letters Patent is hereby corrected as shown below:

Title page,
Item [56], References Cited, FOREIGN PATENT DOCUMENTS,
"09244355 A" should read -- 9-244355 A --.

Column 3,
Lines 1-3, close up left margin; and
Line 11, "is" should read -- it is --.

Column 7,
Line 31, "plenty of" should read -- much --; and
Line 33, "very plenty of" should read -- very much --.

Column 8,
Line 39, "said" should read -- wherein said --;
Line 44, "lessened," should read -- lessened and --; and
Line 47, "claim 1," should read -- claim 1, wherein --.

Signed and Sealed this

Twenty-first Day of February, 2006

JON W. DUDAS
*Director of the United States Patent and Trademark Office*